United States Patent [19]

Matthews

[11] 4,304,545

[45] Dec. 8, 1981

[54] FUEL SUPPLY AND IGNITION CONTROL SYSTEM EMPLOYING FLAME SENSING VIA SPARK ELECTRODES

[75] Inventor: Russell B. Matthews, Tucson, Ariz.

[73] Assignee: Johnson Controls, Inc., Milwaukee, Wis.

[21] Appl. No.: 100,287

[22] Filed: Dec. 5, 1979

Related U.S. Application Data

[63] Continuation-in-part of Ser. No. 966,009, Dec. 4, 1978, Pat. No. 4,269,589, and a continuation-in-part of Ser. No. 790,408, Apr. 25, 1977, Pat. No. 4,178,149.

[51] Int. Cl.[3] ..... F23Q 23/00

[52] U.S. Cl. ..... 431/25; 431/46

[58] Field of Search ..... 431/25, 43, 42, 46, 431/51, 59, 66, 71, 78; 137/66

[56] References Cited

U.S. PATENT DOCUMENTS

| | | | |
|---|---|---|---|
| 2,627,308 | 2/1953 | Clark | 431/51 |
| 2,688,363 | 9/1954 | Taricco | 431/43 |
| 3,902,839 | 9/1975 | Matthews | 431/25 X |
| 3,914,092 | 10/1975 | Matthews | 431/66 |
| 3,955,910 | 5/1976 | Matthews | 431/25 |
| 4,188,182 | 2/1980 | Junak | 431/25 X |

*Primary Examiner*—Samuel Scott
*Assistant Examiner*—Randall L. Green
*Attorney, Agent, or Firm*—Emrich, Root, Lee, Brown & Hill

[57] ABSTRACT

A fuel supply and ignition control system for controlling the operation of pilot and main valves in an intermittent pilot type system. At the start of an ignition cycle, the pilot valve is operated to supply fuel to a pilot outlet for ignition by sparks generated by a spark generating circuit. When the pilot fuel is ignited, the pilot flame bridges the spark gap, and a flame sensing network, which is connected in circuit with the spark electrodes, generates a flame signal which is applied to an enabling circuit which responsively effects operation of the main valve. The enabling circuit includes a controllable switching device which in one embodiment, is maintained disabled in the absence of a flame signal and is enabled to cause a flame relay to operate and energize the main valve when a flame signal is provided. In another embodiment, the controllable switching device is enabled in the absence of a flame signal and causes an SCR device to conduct, providing a low impedance energizing path for the pilot valve operate winding and a shunt path around the main valve operate winding. When a flame bridges the spark gap, the flame signal disables the switching device so that the SCR device is rendered non-conducting, interrupting the shunt path around the main valve winding allowing the main valve to operate.

13 Claims, 3 Drawing Figures

FUEL SUPPLY AND IGNITION CONTROL SYSTEM EMPLOYING FLAME SENSING VIA SPARK ELECTRODES

RELATED APPLICATIONS

This is a continuation-in-part application of co-pending applications Ser. No. 790,408, filed Apr. 25, 1977 now U.S. Pat. No. 4,178,149, issued Dec. 11, 1979 and Ser. No. 966,009, filed Dec. 4, 1978 now U.S. Pat. No. 4,269,589 issued May 26, 1981. As to common subject matter, applicant claims the benefit fo the priority of said applications under 35USC 120.

BACKGROUND OF THE INVENTION

1. Field of the Invention

This invention relates to fuel ignition systems of the intermittent pilot type, and more particularly to a control circuit for use in such systems which provides fail-safe control of fuel valves of the system, and in which pilot flame sensing is effected using the spark electrodes.

2. Description of the Prior Art

In fuel ignition and control systems of the pilot ignition type, a pilot valve is operated to supply fuel to a pilot outlet for ignition by sparks provided by a spark generating circuit to establish a pilot flame. A pilot flame sensing circuit detects the pilot flame and effects the energization of a main valve to supply fuel to a main burner for ignition by the pilot flame. In such arrangement, the main valve is operated only when the presence of the pilot flame is proven.

Typically, the flame sensing circuit includes a separate flame sensing probe which is mounted in the proximity of the pilot outlet. When the pilot fuel is ignited, the pilot flame impinges on the sensing probe, permitting current to flow through the flame sensing network, generating a signal, commonly referred to as a flame signal. The flame signal is applied to a main valve control circuit to effect energization of the main valve.

While the use of a flame probe and its associated flame sensing network provides a convenient way of detecting the presence of a pilot flame, in some gas furnace installations, there may be insufficient space to permit mounting the separate flame sensing probe near the pilot outlet or at least close enough to the outlet to permit the flame to impinge on the probe. Also, the need for the separate flame sensing probe and the probe connecting wire adds cost to the system.

It would be desirable to have a fuel ignition and control circuit which provides fail-safe operation of the fuel valves of the system which does not require a separate flame sensing probe for detecting the pilot flame.

SUMMARY OF THE INVENTION

The present invention provides a control circuit for controlling the operation of pilot and main valves in a proven pilot fuel control and ignition system, such as that for a furnace in a heating system, and in which pilot flame sensing is effected using the electrodes of the spark generating circuit which ignites the pilot fuel. The control circuit includes a flame sensing network which is connected in circuit with the spark electrodes. In the absence of a pilot flame, the spark electrode gap presents a high impedance which prevents current flow through the network. However, when a pilot flame bridges the spark gap, the resistance of the gap is effectively lowered enabling current flow through the flame sensing network generating a flame signal which is applied to an enabling circuit which controls the operation of the main valve as a function of the presence or absence of a pilot flame as indicated by the presence or absence of the flame signal provided by the flame sensing network.

In one embodiment, the enabling current includes a capacitor, the charging of which is controlled as a function of the presence or absence of a flame so that a controllable switching device of the enabling current is maintained disabled in the absence of a flame, and is enabled, providing a discharge path for the capacitor, when a flame bridges the spark gap. When the capacitor discharges over the controllable switching device, an enabling signal is generated to effect operation of a flame relay to energize the main valve to operate.

In the absence of the predetermined threshold voltage for the controllable switching device, the capacitor is decoupled from the flame relay so that energization of the main valve is prevented. Also, for virtually any fault of the enabling circuit, including open or short conditions for the capacitor, the controllable switching device is either maintained off for the discharge current provided by the capacitor as insufficient to effect enabling of the flame relay so that the main valve is maintained unoperated.

In another embodiment, the operate windings of the pilot and main valves are connected in series and are energized under the control of a silicon controlled rectifier which is connected in parallel with the main valve winding. The SCR device is operated between conducting and non-conducting states by the enabling circuit. In this embodiment, the controllable switching device is enabled in the absence of a flame and causes the SCR device to conduct and provide a shunt circuit path around the main valve operate winding, preventing the main valve from operating, while providing a low impedance energizing path for the pilot valve operating winding, allowing the pilot valve to operate. When the pilot fuel is ignited, and the pilot flame bridges the spark gap, the flame sensing generates a flame signal which inhibits the enabling circuit causing the controllable switching device to be cut off. Consequently the SCR device is also cut off, interrupting the shunt path around the main valve winding permitting the main valve to operate. In this embodiment, the SCR device must be operated from its non-conducting to its conducting state to energize the pilot valve solenoid and, when a flame is established, the SCR device must be operated from its conducting to its non-conducting state to permit energization of the main valve. The resistance of the main valve solenoid limits current flow through the pilot valve winding to a value below its operating level when the SCR device is non-conducting so that the pilot valve operating is conditioned upon conduction of the SCR device at the start of an ignition cycle.

DESCRIPTION OF PREFERRED EMBODIMENTS

Figure 1:
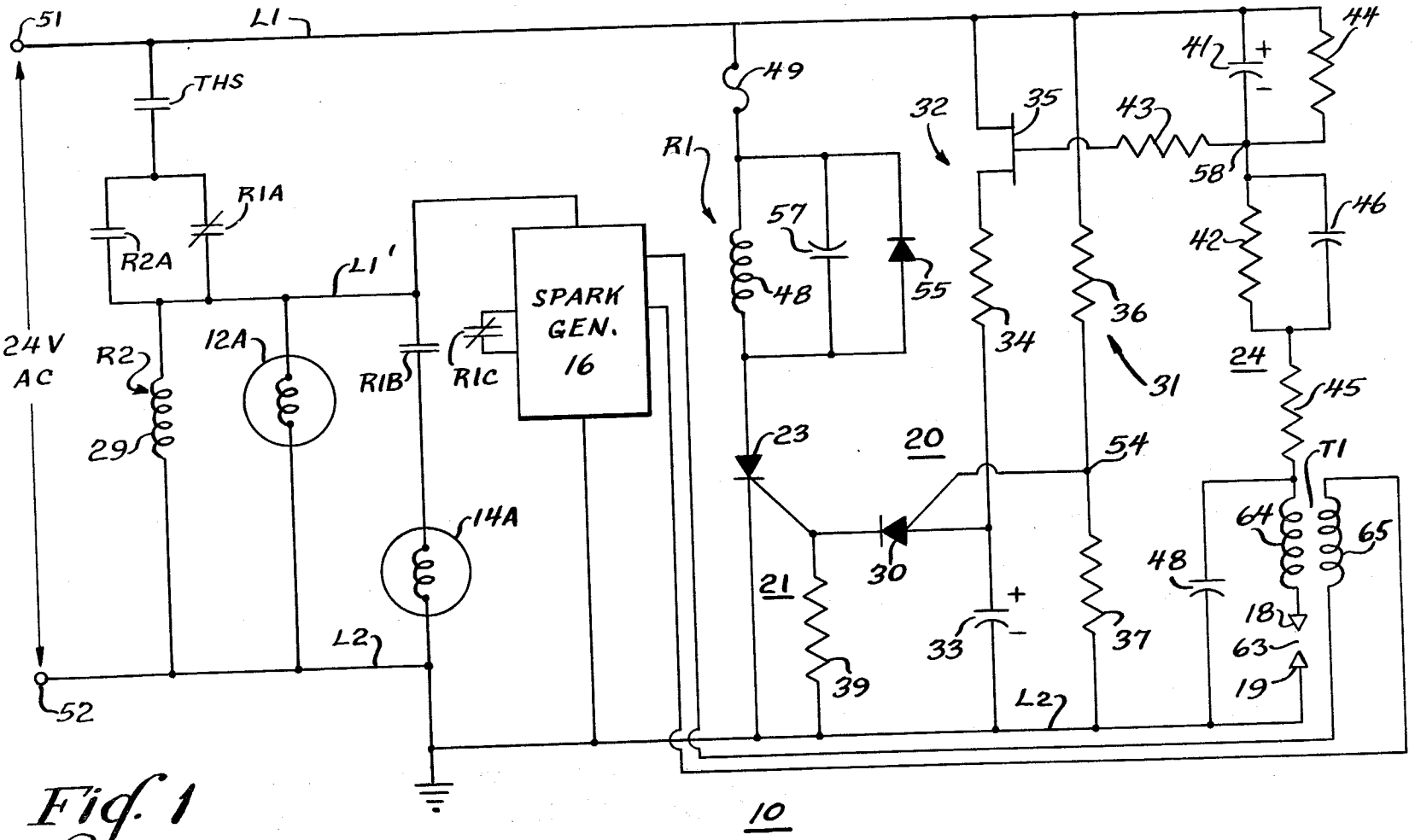
FIG. 1 is a schematic circuit diagram for a control circuit for fuel ignition and control system provided by the present invention.

Referring to the drawings, the control circuit 10, shown in FIG. 1, is described with reference to an application in a fuel ignition and control system which, for example, may be employed in a heating system of the intermittent pilot type. In such system, a pilot valve 12, shown in FIG. 2, supplies fuel to a pilot outlet 13 where it is ignited by sparks provided at spark electrodes 18 and 19 by a spark generating circuit 16. When the pilot fuel is ignited, the control circuit 10 enables a main valve 14 to operate and supplies fuel to a main burner 15 of the heating system for ignition by the pilot flame.

Referring to FIG. 1, the pilot valve solenoid 12A and the spark generating circuit 16 are energized in response to a request for heat as signaled by the closing of thermostatically controlled contacts THS. When a pilot flame is established, the main valve solenoid 14A is energized under the control of a flame relay R1, the operation of which is controlled by an enabling circuit 20 via a silicon controlled rectifier 23. In the absence of a pilot flame, the enabling circuit 20 maintains the SCR device 23 turned off, thereby interrupting the energizing path for the operate winding of the relay R1. When a pilot flame is established at the pilot outlet 13, a flame sensing network 24 provides a signal to the enabling circuit 20 which responsively turns on the SCR device 23 completing the energizing path for the flame relay R1 which then operates causing the main valve to be operated.

In accordance with one aspect of the invention, the flame sensing network 24 is connected in circuit with the spark electrodes 18 and 19 and the presence of the pilot flame is sensed using spark electrodes, rather then a separate flame sensing electrode. In the absence of a flame, the spark electrode gap presents a high impedance, virtually an open circuit. This effectively inhibits the flame sensing network 24 by preventing current flow through the network. However, when the pilot fuel is ignited, the pilot flame bridges the spark gap, effectively lowering its resistance. This enables charging current to be supplied to a capacitor 41 of the flame sensing network, and when the capacitor 41 is charged, the flame sensing network 24 provides a signal to the enabling circuit 20 which effects operation of the main valve.

In accordance with another aspect of the invention, the enabling circuit 20 includes a programmable unijunction transistor 30 which is a controllable switching device that has a given turn-on threshold. That is, the PUT device 30 conducts only when the potential at its anode is at least +0.6 volts greater than the potential at its gate. A reference network 31, including resistors 36 and 37, determines the gate potential for the PUT device 30, and a control network 32, including a capacitor 33, a resistor 34, and a field-effect transistor 35, determines the anode potential for the PUT device 30.

The flame sensing network 24 controls the biasing of the FET device 35 to limit the charging of the capacitor 33 in the absence of a pilot flame whereby the difference between the anode and gate potentials of the PUT device 30 does not exceed the turn-on valve so that the PUT device 30 is maintained off. However, when a pilot flame is provided, the flame sensing network 24 controls the biasing of the FET device 35 to permit the capacitor 33 to charge to a valve such that the PUT turn-on threshold is exceeded, and the PUT device 30 conducts. The capacitor 33 then discharges through the PUT device into the gate of the SCR device 23 which turns-on, energizing the operate winding of the flame relay R1 to operate the relay and effect energization of the main valve solenoid 14A.

In the absence of the predetermined threshold voltage for the PUT device 30, the capacitor 33 is decoupled from the SCR device 23 so that the SCR device is maintained off, interrupting the energizing path for the flame relay winding 43. Also, for virtually any fault of the enabling circuit, including open or short conditions for capacitor 33, the PUT device 30 is either maintaind off, or the discharge current provided by the capacitor 33 is limited to a value insufficient to enable the SCR device 23 so that the flame relay R1 and the main valve 14 are maintained unoperated.

To further enhance the failsafe operation of the circuit, the pilot valve solenoid 12A is energized over a path including normally closed contacts R1A of the flame relay R1. A checking relay R2 which is also energized over the contacts R1A operates and closes contacts R2A, which are connected in shunt with contacts R1A, to provide a holding path for the pilot valve solenoid 12A when the flame relay operates to open contacts R1A. This checking arrangement prevents operation of the pilot valve, as well as the main valve, if for any reason the contacts R1A are open at the start of a trial for ignition cycle.

DETAILED DESCRIPTION

Considering the control circuit 10 in more detail, input terminals 51 and 52 are connectable to a 24 VAC source to energize the circuit. The valve solenoids 12A and 14A and at the spark generating circuit 16 are connected in circuit with normally open thermostatically controlled contacts THS between conductors L1 and L2. Conductors L1 and L2 are connected to terminals 51 and 52 to extend the AC signal to the enabling circuit 20 and the flame sensing network 24 which are energized continuously and independently of the contacts THS.

The pilot valve solenoid 12A has one terminal connected to a conductor L1' which is connectable via contacts R1A and THS to conductor L1, the other terminal of the solenoid 12A being connected to conductor L2. The operate winding 29 of the checking relay R2 is connected in parallel with the valve solenoid 12A between conductors L1' and L2. The main valve solenoid 14A is connected in series with normally open contacts R1B of the flame relay between conductors L1' and L2.

The spark generating circuit 16 is also connected between conductors L1' and L2. The spark generating circuit 16 is similar to one disclosed in my U.S. Pat. No. 4,077,762, and accordingly will not be described in detail in this application. For purposes of this disclosure, it is sufficient to state that the spark generating circuit 16 is of the capacitor discharge type and includes a capacitor (not shown) which is charged and then discharged over the primary winding 65 of an ignition transformer T1 during alternate half cycles of the AC line signal. When the capacitor discharges over the transformer winding, high voltage pulses are generated at the secondary winding 64 of the transformer and are applied to the spark electrodes 18 and 19, causing sparks to be generated in the gap 63 between the spark electrodes 18 and 19. The spark generating circuit 16 generates sparks until the pilot fuel is ignited and the flame relay R1 is operated. When relay R1 operates, contacts R1C are open, disabling the spark generating circuit 16. As is described in the referenced patent, the spark generating circuit continues to operate, generating sparks, for a short term following the operation of the flame relay. A capacitor 48 which is connected in shunt with the secondary winding 64 and the spark electrodes, provides a return path to ground for the high voltage signal.

Figure 2:
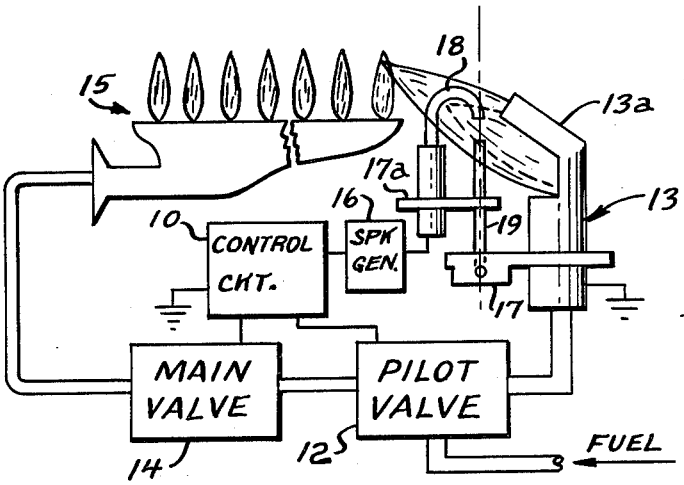
FIG. 2 is a symbolic representation of the fuel ignition and control system illustrating the positioning of the spark electrodes relative to the pilot outlet and main burner of the system.

Referring to FIG. 2, which illustrates the physical arrangement of the pilot outlet 13, the main burner 15 and the spark electrode assembly, one of the spark electrodes 19 has one end rotatably mounted in a mounting member 17 which is secured to the pilot outlet 13 and grounded there through. The other spark electrode 18 has one end secured to the electrode 19, and electrically insulated therefrom, by a mounting member 17A. The free ends of the electrodes are disposed in close proximity, defining the spark gap 65. As shown, the spark electrode assembly is positioned between the main burner 15 and the pilot outlet 13 with the spark gap being positioned near the pilot fuel deflector 13A. In order to keep the turndown flame size the same as when a separate flame sensing probe is used, the spark gap is located at the same distance from the pilot burner 13 as the separate flame sensing probe if such probe were used. The rotatable mounting of the spark electrode assembly, via mounting member 17, permits rotation of the spark electrode assembly about a vertical axis represented by the dashed line. This provides a degree of freedom in mounting the spark electrode assembly in gas burner installations, particularly when space limitation is a factor.

Referring to the enabling circuit 20 shown in FIG. 1, resistors 36 and 37 of the reference network 31 are connected in series between conductors L1 and L2. The junction of the resistors 36 and 37 at point 54 is connected to the gate of the PUT device 30, enabling an AC reference voltage to be established at the gate of the PUT device 30 whenever power is applied to conductors L1 and L2.

Capacitor 33 and resistor 34 of the control network 32 are connected in series with the source-to-drain circuit of the FET device 35 between conductors L1 and L2. The FET device 35 may, for example, be an N-channel, depletion mode field effect transistor, such as the Type 2N5458.

The FET device 35 conducts whenever its gate potential is positive with respect to its source potential. In the absence of a charge on capacitor of the flame sensing network, the FET device 35 conducts current in both directions, resulting in an average net charge of zero volts on the capacitor 33. For such case, the anode-to-gate potential for the PUT device cannot exceed +0.6 volts, and the PUT device 30 remains cutoff. However, when capacitor 41 is charged, then the potential at the gate of the FET device 35 is maintained negative with respect to the potential at the source of the FET device 35, so that the FET device 35 is "pinched off" during negative half cycles of the AC line signal. For such condition, the FET device 35 conducts unidirectionally, preventing capacitor 33 from discharging so that capacitor 33 assumes a net charge. When capacitor 33 is charged to a value which results in a potential of +0.6 volts between the anode and gate of the PUT device 30, the PUT device 30 is enabled.

The gate potential for the FET device 35 is established by the flame sensing network 24 which includes capacitor 41 and resistors 42–44. Capacitor 41 is connected in a series charging path which extends from conductor L1 through capacitor 41, resistor 42 and the spark electrodes 18 and 19 to ground. The junction of resistor 42 and capacitor 41 at point 58 is connected over resistor 43 to the gate of the FET device 35. The resistor 44 is connected in parallel with capacitor 41 between conductor L1 and point 58, providing a bleeder path for the capacitor 41. A capacitor 46 is connected between point 58 and electrode 18 to reduce the spark interference which could otherwise increase the minimum sensing voltage. Resistor 45 blocks out RF interference from the spark.

The cathode of the PUT device 30 is connected to the gate of the SCR device 23, and over a resistor 39 to conductor L2. The SCR device 23 has its anode connected to one side of the operate winding 48 of the flame relay R1, the other side of which is connected over a fuse 49 to conductor L1. The cathode of the SCR device 23 is connected to conductor L2 so that when the SCR device 23 is enabled, the operate winding 48 of the relay R1 is effectively connected between conductors L1 and L2, permitting the relay R1 to operate. During the time that the SCR device 23 in non-conducting, in response to the current reversal at the start of a negative half cycle of the AC signal, the relay R1 is maintained energized by a capacitor 57 and freewheeling diode 55, which are connected in parallel with the operate winding 48 of the relay R1.

OPERATION

When AC power is applied to input terminals 51 and 52, the enabling circuit 20 is energized via conductors L1 and L2. However, since contacts THS are open, the fuel valve solenoids remain unenergized. In the absence of a pilot flame, the flame sensing network 24 biases the FET device 35 such that it conducts bidirectionally, during alternate half cycles of the AC signal, permitting capacitor 33 to charge and then discharge during each cycle of the AC signal. Under such condition, the potential provided by the control network 32 at the anode of the PUT device 30 does not exceed the reference signal provided at the gate of the PUT device 30 by the reference network 31, so that the PUT device is maintained cutoff.

When contacts THS close to start an ignition cycle, a circuit path is completed via contacts THS and R1A from conductor L1 to conductor L1'. Accordingly, the spark generating circuit 16 is energized and generates sparks at the spark electrodes 18 and 19. The pilot valve solenoid 12A is also energized, and the pilot valve operates, supplying fuel to the pilot outlet 13 for ignition by the sparks. The operate winding 29 of the checking relay R2 is also energized, and the relay operates closing contacts R2A to complete the holding path for the pilot valve solenoid via contacts THS and R2A.

In the absence of a flame, the charging circuit for capacitor 41 of the flame sensing network is virtually an open circuit, preventing the flow of charging to capacitor 41. However, whenever a flame bridges the spark gap, the resistance through the flame is in the order of 30 Megohms and current flows during positive half cycles of the AC line signal from conductor L1 through capacitor 41 and resistors 42 and 45 and through the flame to ground. The flame both conducts and rectifies the current providing a DC current for charging the capacitor 41 with the polarity indicated in FIG. 1. When the potential at the junction of capacitor 41 and resistor 42 at point 58 is negative with respect to conductor L1, the gate of the FET device 35, which is coupled to point 58 via resistor 43.

Accordingly, when capacitor 41 is charged, during positive half cycles of the AC line signal, current flows through the FET device 35, the resistor 34 and the capacitor 33, charging the capacitor 33 to the polarity indicated in FIG. 1. During negative half cycles of the AC line signal, capacitor 41 maintains the potential at the gate of the FET device 35 negative with respect to the potential at the source of the device 35, and the device 35 is "pinched-off" blocking reverse current flow through capacitor 33, preventing it from discharging. After several cycles of the AC line signal, the capacitor 33 is charged sufficiently to cause the potential at the anode of the PUT device 30 to exceed the gate potential by +0.6 volts. The values for the resistor 34 and the capacitor 33 are chosen so that the time required for the charge on capacitor 33 to exceed the gate voltage established by the voltage dividing resistors 36 and 37 is greater than one cycle of the AC line signal, and may for example be in the order of four cycles. When the turn on threshold for the PUT device is exceeded, the PUT device 30 conducts and discharges the capacitor 33 into the gate of the SCR device 23 and resistor 39 during a positive half cycle.

Accordingly, the SCR device 23 conducts, energizing the operate winding of relay R1 which then operates to open contacts R1A and R1C and to close contacts R1B. When contacts R1B close, the operate solenoid 14A of the main valve 14 is connected to the holding path for energization and the main valve 14 operates to supply fuel to the main burner 15 for ignition by the pilot flame. When contacts R1C open, the spark generating circuit 16 is disabled terminating further spark generation after the delay afforded by the timer of the spark generating circuit.

For a flame out condition, or before a flame is established at start-up, the FET device 35 conducts during both positive and negative half cycles of the AC line signal, resulting in an average net charge of zero volts on the capacitor 33. The PUT device 30 is held cutoff and the relay R1 is maintained deenergized.

When the heating demand has been met, contacts THS open, deenergizing the fuel valves 12 and 14, and deactivating the flame sensing circuit 18 causing relay R1 to drop out and the system 10 is prepared for the next ignition cycle.

SOLID STATE VALVE CONTROL CIRCUIT

Figure 3:
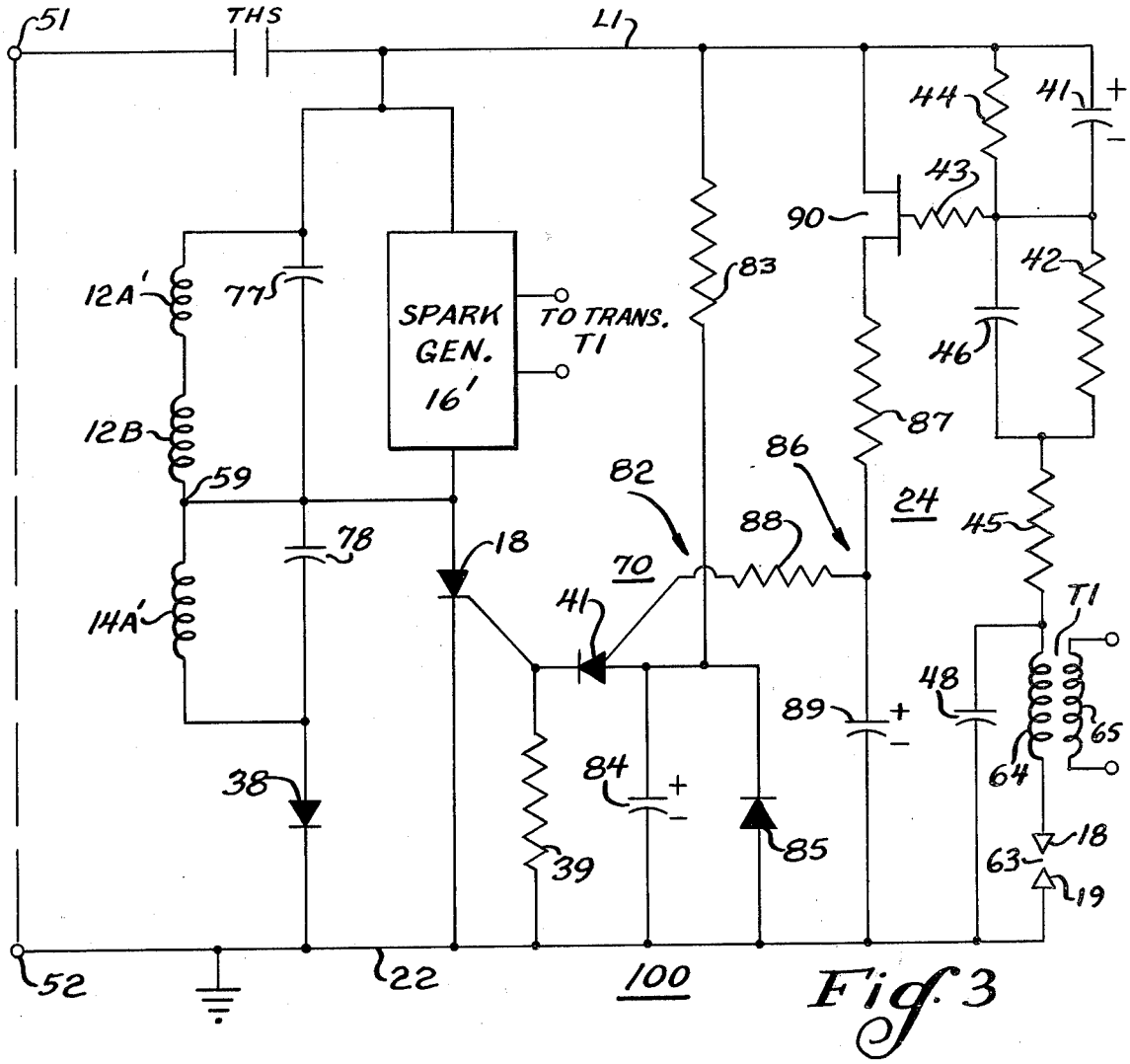
FIG. 3 is a schematic circuit diagram of a second embodiment for a control circuit for a fuel ignition and control system provided by the present invention.

Referring to FIG. 3, there is shown a schematic circuit diagram of a control circuit 100 for a fuel ignition and control system provided in accordance with a second embodiment of the invention, and in which the operation of the main valve is controlled by a solid state switching device rather than by an electromechanical relay. In the circuit 100, the pilot valve 12 has a pickup winding 12A and a hold winding 12B which are connected in series with the main valve solenoid winding 14A between conductors L1 and L2. A silicon controlled rectifier 18', which is connected in parallel with the main valve solenoid windings 14A', is operated by an enabling circuit 70 and a flame sensing network 24 to provide a shunt circuit path around the main valve winding 14A' during trial for ignition, effectively decreasing the resistance of the pilot valve winding energizing circuit, allowing current at an operating level to flow through the pilot valve windings. The SCR device 18 is rendered non-conducting when a flame is established, allowing current to flow through the main valve solenoid winding 14A to operate the main valve.

The enabling circuit 70 is similar to enabling circuit 20 described hereinabove. However, in control circuit 100, the charging of a capacitor 89 of the reference network 86 is controlled by an FET device 90 as a function of the absence or presence of a flame. This enables the PUT device to conduct in the absence of a flame to cause the SCR device 18 to conduct and provide the shunt path around the main valve winding. The PUT is turned off to cause the SCR device 18 to turn off, interrupting the shunt path, when a flame is sensed.

The flame sensing network 24 corresponds to the one described above with reference to FIG. 1 which provides flame sensing via the spark electrodes 18 and 19.

In the absence of a request for heat, thermostatically controlled contacts THS are open so that the valve solenoid circuits, the enabling circuit 70, and the flame sensing network 24 are deenergized. When contacts THS close in a request for heat, the enabling circuit 70 is energized and generates trigger pulses causing the SCR device 18 to turn on and provide a shunt path around the main valve operate winding 14A'. This reduces the resistance in series with the pilot valve solenoid windings, permitting current at an operating level to flow through the pilot valve pickup winding 12A' causing the pilot valve to operate and supply fuel to the pilot outlet 13. A spark generating circuit 16' is also energized and generates sparks at spark electrodes 18 and 19 for igniting the pilot fuel.

When the pilot fuel is ignited and the pilot flame bridges the gap between the spark electrodes 18 and 19, the flame sensing network 24 responsively inhibits the enabling circuit 70 causing the SCR device 18 to be rendered nonconducting. This interrupts the shunt circuit path around the main valve solenoid winding 14A' permitting the main valve to operate and supply fuel to the main burner 15 for ignition by the pilot flame. The pilot valve solenoid windings are maintained energized over a path including the main valve solenoid winding 14A when the SCR device 18 is rendered non-conducting.

DETAILED DESCRIPTION

Considering the circuit in more detail, power is supplied to the circuit 100 over input terminals 51 and 52 which are connectable to a source of 24 VAC. The energizing signal is extended to conductors L1 and L2 whenever contacts THS are closed. As indicated above, in the circuit 100, the enabling circuit 70 and the flame sensing network 24 are energized only when contacts THS are closed.

The pilot valve solenoid pick-up winding 12A' and hold winding 12B are connected in series opposition to provide an effective voltage dropping resistor. Windings 12A' and 12B are connected in series with the main valve solenoid winding 14A' in a series circuit path along with diode 38 between conductors L1 and L2. The diode 38 provides a unidirectional circuit path for the valve solenoids permitting current flow through the solenoid windings during positive half cycles of the AC signal. Capacitors 77 and 78 which charge up during the positive half cycles, provide discharge current for maintaining the solenoid windings energized during negative half cycles.

The SCR 18 has its anode-cathode circuit connected in parallel with the main valve solenoid winding 14A and the diode 38. In one circuit which was constructed, the pick-up winding 12A' comprised 725 turns of number 31 wire, and the hold winding 12B comprised 400 turns of number 29 wire. The number of turns on the pilot valve windings is kept low to prevent the pilot valve from opening when the SCR device 18 is non-conducting. Conversely, the resistance of the main valve solenoid winding 14A is large enough to prevent the pilot valve from being energized at the maximum circuit voltage while permitting the main valve to be energized at the minimum circuit voltage.

The spark generating circuit 16' is connected in series with the SCR device 18 between conductors L1 and L2. The spark generating circuit 16' may be similar to one shown and described in my U.S. Pat. No. 3,902,839, which is assigned to the assignee of this application. When energized, the spark generator 16' generates high voltage pulses which are applied via ignition transformer TI to the spark electrodes 18 and 19 causing sparks to be generated in the proximity of the pilot outlet 13 for igniting the pilot fuel. The spark generating circuit 16' is deenergized when the SCR device 18 is rendered non-conductive in following detection of the flame by the flame sensing network 24.

Referring to the enabling circuit 70, the PUT device 41 has a control network 82 including a resistor 83 and a capacitor 84 and a reference network 86 including resistors 87 and 88, a capacitor 89 and a field effect transistor 90. Resistor 83 and capacitor 84 are connected in series between conductors L1 and L2 permitting capacitor 84 to charge during positive half cycles of the AC signal when conductor L1 is positive with respect to conductor L2, establishing a control potential at the anode of the PUT device. A diode 89 bypasses capacitor 84 during negative half cycles of the AC signal.

Resistor 87 and capacitor 89 of the reference network 86 are connected in series with the source-to-drain circuit of the FET device 90 between conductors L1 and L2, providing a reference voltage at the junction of resistor 87 and capacitor 89 which is coupled via resistor 88 to the gate of the PUT device 41. The gate of the FET device 90 is connected via resistor 43 to the junction of capacitor 41 and resistor 42 of the flame sensing network 24 which controls the biasing of the FET device 90 in the manner described above with reference to control circuit 10 shown in FIG. 1. That is, the absence of a flame the FET device 90 is biased to conduct bidirectionally whereas when a flame bridges the spark gap, the FET device 90 is biased to conduct only during positive half cycles of the AC signal.

In the absence of a flame, the PUT device 41 is rendered conductive during each cycle of the AC signal, permitting capacitor 84 to discharge over the anode-cathode current of the PUT device 41 and a resistor 92, providing a bigger pulse to the gate electrode of the SCR device 18. When a flame bridges the spark gap, the PUT device is maintained off, keeping the SCR device 18 off.

OPERATION

When the contacts THS close in response to a request for heat, a 24 VAC energizing signal is extended to conductors L1 and L2, energizing the enabling circuit 70 and the flame sensing network 24. Initially, the SCR device 18 is non-conducting so that the spark generating circuit 16' is deenergized and the main valve winding 14A' limits current flow through the pilot windings 12A' and 12B to a level below the operate level.

When conductors L1 and L2 are energized, then during each positive half cycle of the AC signal current flows from conductor L1, through resistor 83 and capacitor 84 to conductor 12, charging the capacitor 84. Current also flows from conductor L1 through the FET device 90, resistor 87 and capacitor 89 to conductor L2, charging capacitor 89. The values of resistors 83 and 87 and capacitors 84 and 89 are selected so that as the capacitors 84 and 89 charge, the anode-to-gate potential of the PUT device 41 exceeds the turn on value near the midpoint of each positive half cycle, and at a time when capacitor 87 has charged sufficiently to trigger on the SCR device 18 upon discharge of capacitor 84 over the PUT device 41. Stated in another way, capacitor 84 charges at a faster rate than capacitor 89 so that near the midpoint of the positive half cycles, the potential at the PUT anode exceeds the PUT gate potential by +0.6 volts.

Since the FET device 90 is biased to conduct bidirectionally in the absence of a flame, capacitor 89 discharges during each negative half cycle. As long as capacitor 89 of the reference network is discharged each cycle, the control voltage at the PUT anode will exceed the reference voltage at the PUT gate by +0.6 volts, causing the PUT device 41 to turn on and discharge the capacitor 84, generating a trigger pulse for the SCR device 18. Since the SCR device 18 is cut off with the current reversal at the start of each negative half cycle, the enabling circuit 70 provides a trigger pulse for the SCR device 18 during each cycle until a flame is sensed.

When the SCR device 18 is operated to its conductive state, the spark generating circuit 16' is energized and generates sparks at electrodes 18 and 19. Also, the SCR device 18 provides a shunt circuit path to conductor L2, around the main valve winding 14A, lowering the effective resistance of the pilot valve winding energizing circuit so that current at the operating level flows through the pick up winding 12A', causing the pilot valve to operate and supply fuel to the pilot outlet for ignition.

As described with reference to FIG. 1, in the absence of a flame, the spark electrodes 18 and 19 present a virtual open circuit in the charging path for capacitor 41 of the flame sensing network 24. For such condition, the flame sensing network biases the FET device 90 to conduct bidirectionally. However, when a flame bridges the spark gap, the flame sensing network provides a signal to the gate of the FET device 90 causing it to be "pinched-off" during negative half cycles of the AC signal, preventing capacitor 89 from discharging.

As capacitor 89 charges, the reference voltage increases and eventually reaches a value such that the control voltage at the PUT anode cannot exceed the reference voltage at the PUT gate so that the PUT device can no longer conduct, or be pulsed on. The time constant of resistor 87 and capacitor 89 is selected to be in the order of fifteen milliseconds. Accordingly, capacitor 89 must charge for several cycles of the AC signal before the reference voltage reaches a level which inhibits the enabling circuit 70.

When the PUT device 41 stops conducting, the SCR device 18 is no longer enabled. Accordingly, with the shunt path removed from the main valve winding 14A', and current flows through the main valve winding 14A' and diode 38, energizing the winding. The main valve 14 operates and supplies fuel to the main burner 15 for ignition by the pilot frame. Also, the current through the pilot valve windings is reduced to a holding level when the SCR device 18 is cut off, the spark generating circuit 16' is disabled, terminating further spark generation as long as a flame is sensed.

Following successful ignition, the pilot and main valves remain operated until the contacts THS open when the demand for heat has been met. Should a flameout occur following a successful ignition, capacitor 41 of the flame sensing network 24 is discharged permitting the FET device 90 to conduct bidirectionally and discharge capacitor 89. This decreases the potential at the gate of the PUT device 41 enabling the PUT device 41 to be rendered conducting by the control network 82, and generate trigger pulses during each cycle at the AC signal. The SCR device 18 is reenabled by the pulses, shunting the main valve solenoid 14A' while maintaining the pilot valve windings energized for a new trial for ignition interval. The spark generating circuit 16' is also enabled to provide sparks for reigniting the pilot fuel.

When the flame is reestablished, the flame sensing network inhibits the enabling circuit 70 as described above rendering the SCR device 18 non-conducting to reenergize the main valve, and to disable the spark generating circuit 16'.

Should a fault occur such that the SCR device 18 is maintained disabled at the start of an ignition cycle, then when contacts THS close, the pilot valve cannot operate because the current to the pilot valve solenoid is held below the operating level since the pilot valve windings are energized through the main valve winding. If, on the other hand, a circuit fault should occur that causes the SCR device 18 to conduct in the presence of a flame, the main valve winding **14*a* will be effectively shorted via the SCR device 18** and the main valve will be deenergized.

I claim:

1. In a fuel supply and ignition control system including a pilot valve operable to supply fuel to a pilot outlet for ignition; spark generating means including spark electrode means located in the proximity of the pilot outlet defining a spark gap, and means for actuating said spark electrode means to generate sparks for igniting the pilot fuel to provide a pilot flame which bridges the spark gap; and a main valve operable to supply fuel to a main burner for ignition by the pilot flame; a control circuit comprising: activate means for effecting energization of said pilot valve; a flame sensing network connected to said spark electrode means and operable to provide a flame signal whenever a flame bridges the spark gap; bistable switching means for controlling the operation of said main valve; enabling means interposed between said switching means and said flame sensing network for operating said switching means between a first state in which said switching means prevents operation of said main valve and a second state in which said switching means effects operation of said main valve, said enabling means including a controllable switching device having first and and second control inputs and an output connected to said switching means, control circuit means for providing a control potential at said first control input of said controllable switching device, and reference circuit means for providing a reference potential at said second control input of said controllable switching device, the one of said circuit means which is connected to one of said control inputs including a capacitor and charge control circuit means coupled to said flame sensing network and operable in the absense of said flame signal to enable said capacitor to charge and periodically discharge over a circuit path to limit the potential at said one control input to a given value which provides a first difference between the control and reference potentials, and said charge control circuit means being responsive to said flame signal to permit said capacitor to charge while preventing said capacitor from discharging over said circuit path whereby the potential provided at said one control input is at a value greater than said given value thereby providing a second difference between the control and reference potentials, said controllable switching device being enabled to conduct thereby connecting said control circuit means to said switching means to extend said control potential thereto as an enabling signal when one of said first and second differences is provided between said control and reference potentials, and said controllable switching device being maintained non-conducting in the absence of said one difference between said control and reference potentials thereby isolating said control circuit means from said switching means.

2. A system as set forth in claim 1 wherein said enabling means is energized continuously and independently of said activate means.

3. A system as set forth in claim 1 wherein said control circuit is energized with an alternating current, said charge control means permitting said capacitor to be charged and discharged during alternate half cycles of the alternating current in the absence of said flame signal, and said charge control means responding to said flame signal to permit said capacitor to charge during a plurality of successive cycles of the alternating current and to prevent said capacitor from discharging during said plurality of cycles, said controllable switching device being maintained non-conducting at least until said capacitor is permitted to charge for a time greater than one cycle of the alternating current.

4. A system as set forth in claim 1 wherein said flame sensing network comprises a capacitor and circuit means including resistance means connecting said capacitor in a charging circuit path with said spark electrode means between a source of potential to permit said capacitor to be charged to provide said flame signal when a flame bridges the spark gap.

5. A system as set forth in claim 4 wherein said spark electrode means comprises first and second spark electrodes, and wherein capacitor and said resistance means are connected in series with an output winding of said spark generating means, forming a portion of said charging circuit path, said first spark electrode being connected to a terminal of said output winding and said second spark electrode being disposed in a spaced relationship with said first spark electrode, defining said spark gap and being connected to a point of reference potential for said control circuit whereby when a flame bridges the spark gap, said portion of said charging circuit path is effectively coupled to said point of reference potential.

6. A system as set forth in claim 5 which further comprises capacitance means connected in shunt with said output winding and said first and second spark electrodes, said spark generating means being operable when energized to generate high voltage pulses which are applied to said first and second spark electrodes by way of said output winding and said capacitance means.

7. A system as set forth in claim 1 wherein said activate means includes second switching means connected in a circuit path including first normally closed contacts of said first-mentioned switching means, and switch means operable to connect power to said circuit path for energizing said second switching means, said second switching means being operable when energized to close second contacts to provide a shunt path around said first contacts whereby at least said second switching means is maintained enerigized over said second contacts when said first switching means operates causing said first contacts to open.

8. In a fuel supply and ignition system including a pilot valve operable to supply fuel to a pilot outlet for ignition; spark generating means including electrode means located in the proximity of the pilot outlet defining a spark gap, and means for activating the electrodes to generate sparks for igniting the pilot fuel to provide a pilot flame which bridges the spark gap; and a main valve operable to supply fuel to a main burner for ignition by the pilot flame; a control circuit comprising: activate means for energizing said pilot valve; first switching means operable when enabled to energize said main valve; second switching means having first and second control inputs and an output coupled to said first switching means; first circuit means for providing a reference signal at said first control input of said second switching means for preventing the enabling of said second switching means in the absence of a pilot flame; second circuit means including a capacitor which provides a signal at said second control input of said second switching means; a flame sensing network connected in circuit with said spark electrode means for providing a flame signal whenever a pilot flame bridges the spark gap; and a charge control circuit means including a controllable switching device for controlling the charging of the capacitor, said controllable switching device being operable in the absence of said flame signal to limit the charging of said capacitor whereby said second switching means is maintained disabled in the absence of a flame, and said controllable switching device being responsive to said flame signal to permit said capacitor to charge to a value which provides a signal at said second control input which enables said second switching means to provide a signal at its output which enables said first switching means.

9. A system as set forth in claim 8 wherein said second switching means comprises a further controllable switching device which is enabled whenever the potential at said second control input exceeds the potential at said first control input by a given amount, said further controllable switching device when enabled providing a discharge path for said capacitor to thereby generate a signal for enabling said first switching means.

10. In a fuel supply and ignition system including a pilot valve actuated by a pilot valve solenoid to supply fuel to a pilot outlet for ignition; spark generating means including spark electrode means located in the proximity of the pilot outlet defining a spark gap, and means for activating said spark electrode means to generate sparks for igniting the pilot fuel to provide a pilot flame which bridges the spark gap; and a main valve actuated by a main valve solenoid to supply fuel to a main burner for ignition by the pilot flame; a control circuit comprising: enabling means operable in the absence of a flame at said pilot outlet to generate enabling signals; switching means for controlling the energization of said pilot and main valve solenoids; activate means for enabling said switching means to respond to said enabling signals to operate and provide an energizing path for said pilot valve solenoid to operate said pilot valve; a flame sensing network connected in circuit with said spark electrode means for providing an inhibit signal when a flame bridges the spark gap, and means for coupling said inhibit signal to said enabling means to inhibit the generation of further enabling signals, causing said switching means to be disabled, and said energizing path for said pilot valve solenoid being interrupted when said switching means is disabled, permitting said main valve solenoid to actuate said main valve, said pilot valve solenoid being maintained energized over a holding circuit path including said main valve solenoid after said switching means is disabled.

11. A system as set forth in claim 10 wherein said flame sensing network comprises a capacitor, and circuit means connecting said capacitor in a charging circuit path with said spark electrode means to permit said capacitor to be charged to provide said inhibit signal whenever a flame bridges the spark gap.

12. A system as set forth in claim 11 wherein said enabling means comprises a controllable switching device having first and second control inputs and an output connected to a control input of said switching means, control circuit means connected to said first control input for providing an enabling signal at said first control input, reference circuit means connected to said second control input for providing a reference signal at said second control input, said switching device being enabled for a predetermined difference between said enabling and reference signals, said inhibit signal controlling said reference circuit means to prevent enabling of said switching device thereby terminating the generation of enabling signals for said switching means.

13. A system as set forth in clain 10 further comprising circuit means connecting an operate winding of said pilot valve solenoid and an operate winding of said main valve solenoid in a series circuit path, said activate means being operable to connect power to said series circuit path; said main valve winding limiting the current flow through said series circuit path to a level which is insufficient to actuate the pilot valve, said switching means, when operated, providing a shunt circuit path around said main valve winding permitting current at an operating level to flow through said pilot valve winding to actuate said pilot valve and said shunt circuit path being interrupted when said switching means is thereafter disabled, causing said main valve winding to be energized to actuate said main valve, said pilot valve winding being maintained energized over said series circuit path, including said main valve winding when said switching means is disabled.

* * * * *